US005231711A

United States Patent [19]

Hayakawa

[11] Patent Number: 5,231,711

[45] Date of Patent: Aug. 3, 1993

[54] APPARATUS FOR OPENING AND CLOSING FOLDING BED

[75] Inventor: Tatsuya Hayakawa, Tokyo, Japan

[73] Assignee: Sugatsune Industrial Co., Ltd., Tokyo, Japan

[21] Appl. No.: 841,188

[22] Filed: Feb. 26, 1992

[51] Int. Cl.[5] ..... A47C 17/38

[52] U.S. Cl. ..... 5/160; 5/136

[58] Field of Search ..... 5/4, 6, 136, 159.1, 5/160, 161

[56] References Cited

U.S. PATENT DOCUMENTS

| | | | |
|---|---|---|---|
| 189,776 | 4/1877 | Pabst | 5/160 X |
| 192,711 | 7/1877 | Pabst | 5/160 X |
| 450,600 | 4/1891 | Augier | 5/159.1 |
| 474,587 | 5/1892 | Yeager | 5/160 X |
| 785,220 | 3/1905 | Knaggs | 5/160 X |
| 823,045 | 6/1906 | James | 5/159.1 X |
| 851,910 | 4/1907 | Wilfley | 5/160 X |
| 892,348 | 6/1908 | Baigne | 5/160 X |
| 3,846,852 | 11/1974 | Mercier | 5/6 X |

*Primary Examiner*—Michael F. Trettel

*Attorney, Agent, or Firm*—Jacobson, Price, Holman & Stern

[57] ABSTRACT

An apparatus for opening and closing a folding bed which includes a bed body pivotally rotatably secured to be opened or closed in a cabinet, a front panel divided into an upper panel fixed to the bed body and a lower panel for maintenance access, the lower panel being pivotally secured at a lower end thereof to a lower front portion of the bed body from a pivotal fulcrum of the bed body so as to solely opened or closed by the pivotal rotation of the bed body at the time of storing the bed body, a guide rail provided with the bed body and the lower panel extending longitudinally of the bed body, and an engaging roller projected from the lower panel and coupled to the guide rail to be movable in the opening and closing direction of the bed body, the lower panel being opened or closed in cooperation with the bed body at the time of opening or closing the bed body. Thus, when the upper surface of a mattress is used bed, conventional legs and are eliminated an excellent external appearance is provided with operability, ready for in maintenance work.

2 Claims, 6 Drawing Sheets 2a
13
13a
12
11
13a
14
13b

C
6
8
B
A
2
1a
2b
8a
11
12
2a
13a
13
13b
13c
7
10
4
D
1

APPARATUS FOR OPENING AND CLOSING FOLDING BED

BACKGROUND OF THE INVENTION

1. Field of the Invention

This invention relates to an an apparatus for opening and closing a folding bed of an overlapping type.

2. Description of the Prior Art

There have been two types of conventional folding beds. An overlapping folding bed type in which a front panel attached to a bed body is superposed on a cabinet at the time of foldably containing the bed body therein, and the other being a recessed type of a folding bed in which a front panel is foldably contained inside a cabinet. In both types, it is preferable to have one front panel since a simple external appearance is obtained when the bed body is foldably contained i the cabinet.

In order to use one front panel in the folding bed of an overlapping type, there is known a means for separately providing the rotational shafts of a bed body and a front panel, means for providing the rotational shaft of a bed body at the lower portion of a front panel outside a cabinet, etc.

However, according to the former means, since the rotational shafts of the bed body and the front panel are different, the bed body and the front panel are deviated at a difference between the axes of both the rotational shafts.

On the other hand, according to the latter means, since the rotational shaft of the bed body is projected forward of the cabinet, there arises a problem that the bed body and a front panel rotating force energizing mechanism cannot be arranged with springs, etc., around the shaft.

There is know to eliminate the problems described above by a means for dividing a front panel into upper and lower panels, and utilizing the upper panel as a side panel at the time of using the bed body as a bed.

However, since both the upper and lower panels are coupled to the bed body via a link in this means, it is always cooperated with upon opening or closing of the bed body. Therefore, it cannot be used as a maintenance panel which can be freely opened or closed.

In order to eliminate the above problem, the following folding bed is already known.

In this folding bed, as shown in FIGS. 8 and 9, a front panel is divided into an upper panel a and a lower panel b, the upper panel is fixed to a bed body d rotatably openably supported by a cabinet c, the lower panel b is clamped at the cabinet c with wooden screws, etc., (not shown), and the lower panel b can be removed for maintenance.

However, in the conventional folding bed as described above, since the lower panel b is always fixed to the cabinet c, a relief g for the lower panel b must be cut out at the frame e of the bed body d and the base of a mattress f as shown in FIG. 8. Further, when the bed body d is used as a bed, the upper surface of the mattress f becomes higher, and the bed body d is arranged at a place considerably spaced from a floor surface. As a result, folding legs h must be provided underneath the bed body d. Accordingly, when the bed body d is drawn out from the cabinet c or contained in the cabinet c, the legs h must be extended or retracted, or must be disposed in a containing state or state of use by means of rotation. Thus, the operation is not only complicated, but its aesthetic appearance is lessened.

In FIG. 9, a rotating force energizing mechanism i for the bed body d and the upper panel a is provided.

SUMMARY OF THE INVENTION

A primary object of the present invention is to provide an apparatus for opening and closing a folding bed which can eliminate the problems of the conventional folding bed and which can lower the upper surface of a mattress in case of using as a bed, eliminate conventional legs and provide not only excellent external appearance and operability but ready be readily available for maintenance in a covering type by dividing a front panel into an upper panel and a lower panel, fixing the upper panel to a bed body, opening or closing the lower panel normally in cooperation upon opening or closing of the bed body by a suitable mechanism for engaging or disengaging an engaging roller with or from a guide rail, and only opening or closing it when the bed body is foldably contained.

Another object of the present invention is to provide an apparatus for opening and closing a folding bed which can eliminate the attachment of a member having a catch function separately by performing the primary object by a mechanism for engaging or disengaging an engaging roller with or from a spring instead of the mechanism for engaging or disengaging the engaging roller with or from the guide roller and achieving the closure holding function of the lower panel by the engaging roller and the spring.

In order to achieve the above-described and other objects of the present invention, according to a first aspect of the invention, there is provided an apparatus for opening and closing a folding bed comprising a bed body pivotally rotatably secured to be opened or closed to a cabinet, a front panel divided into an upper panel fixed to said bed body and a lower panel for maintenance, said lower panel being pivotally secured at a lower end thereof to a lower front portion of said bed body from a pivotal fulcrum of said bed body so as to solely opened or closed by the pivotal rotation of said bed body at the time of containing said bed body, a guide rail provided at said bed body with said bed body and said lower panel longitudinally of said bed body, and an engaging roller projected from said lower panel and coupled to said guide rail to be movable in the opening and closing direction of said bed body, said lower panel being opened or closed in cooperation with said bed body at the time of opening or closing said bed body.

According to a second aspect of the preferred embodiment of the invention, the connecting roller which is erected upward or tilted down by the opening force of the lower panel and the bed body at the time of opening or closing solely the lower panel to be engaged with or disengaged from the upper panel is added to the arrangement of the first aspect of the embodiment of the invention.

Operation

According to the first aspect of the preferred embodiment of the invention, when the bed body is contained in the cabinet with the bed body erected upward, the guide rail of the bed body is disengaged from the engaging roller of the lower panel. Therefore, the lower panel can be solely opened or closed by the pivotal rotation of the lower panel.

When an external force is applied to the upper panel as a rotating force of the opening direction (foldably tilting direction) in the containing state of the bed body, the bed body and the upper panel are slightly opened, the engaging roller is brought into contact with the guide rail. When the bed body and the upper panel are further opened, the engaging roller is engaged with the stripe-shaped groove of the guide rail to guide the engaging roller.

Therefore, the lower panel is opened in cooperation with opening of the bed body and the upper panel, and further opened in the state to be intruded into the upper panel and the cutout portion of the side panel. Thus, the bed body and the upper and lower panels are horizontally opened (tilted down) forward of the cabinet, thereby moving into bed using state.

In the bed using state described above, a gap between the bed body and a floor is reduced. Accordingly, a handle project from the front surface of the upper panel can be also used as a leg.

In the bed using state described above, an external force is applied to the upper panel and the bed body as a rotating force in a closing direction (erecting direction) of the bed body. Then, the lower panel is closed upwardly together with the upper panel and the bed body. When the bed body is disposed immediately before the containing state in the cabinet, the lower panel is disengaged from the upper panel and the cutout portion of the side panel, and the engaging roller is disengaged from the stripe-shaped groove of the guide rail. Further, when the upper panel is closed, the bed body is contained in the cabinet, both the upper and lower panels are closed in the covering state on the front surface of the cabinet, thereby providing the containing state of the bed body in the cabinet.

Since the bed body and the upper panel are always moved by the rotating force in a closing direction by the rotating force energizing mechanism internally mounted in the lower portion of the cabinet, when the bed body is opened from the containing state to the bed using state, the bed body is slowly opened against the rotating force. When the bed body is closed from the bed using state to the containing state in the cabinet, the bed body can be closed due to a small force by the rotating force.

A suitable mechanism for self-erecting the lower panel is added at the time of containing the bed body in the cabinet.

According to the second aspect of the preferred embodiment of the invention, when the bed body is contained in the erecting state in the cabinet, the connecting roller is connected in the state to be pressed to the inner surface of the upper panel by a tension of the spring. Thus, the lower panel is held in the closed state.

When an external force is applied to the lower panel as the rotating force of the opening direction of the bed body at the time of containing the bed body in the cabinet, the lower panel is opened. Thus, the connecting roller, i.e. the roller arm, is rotated toward the rear surface of the bed body against the tension of the spring. When the roller arm is rotated to a position exceeding a neutral point, the roller arm is rotated reversely by the spring to be erected and held. Thus, the coupling of the upper and lower panels is disengaged, thereby opening the lower panel.

When the lower panel is closed in the opening state of the lower panel and the connecting roller is brought into contact with the rear surface side of the bed body in the vicinity of the full closure of the lower panel, the roller arm is rotated to a position exceeding the neutral point, thereby tilting down the roller arm to the upper panel side by the tension of the spring. Thus, the roller arm is connected to the inner surface of the upper panel, and the lower panel is held in the closing state. In this case, if the connecting roller is not collided with the bed body, the roller arm is manually rotated to be tilted down.

The lower panel holding force can be regulated by the tension of the spring, etc.

When the external force is applied to the upper panel as the rotating direction of the opening direction in the containing state of the bed body as described above, the upper panel and the bed body are slightly opened in the state to be tilted down forward of the bed at the rotational shaft as a center, the bed body is brought into contact with the lower panel. When they are further opened, the upper end of the lower panel is opened in the state held between the connecting roller and the cutout portion of the side panel of the bed body, the connecting roller is rolled thereon as it is while being pressed to the inner surface of the upper panel, and the lower panel together with the bed body and the upper panel are opened forward of the cabinet into a horizontal state, thereby becoming a bed using state.

When the external force is applied to the upper panel and the bed body as the rotating force of the closing direction (erecting direction) of the bed body in the bed using state of the bed body, the lower panel is closed upward together with the upper panel and the bed body, the bed body is contained in the cabinet, and both the upper and lower panels are closed to the covering state on the front surface of the cabinet, thereby becoming the containing state of the bed body.

The other arrangement of other parts for the second aspect of the preferred embodiment described above is the preferred same as that according to the first aspect of the embodiment of the invention.

BRIEF DESCRIPTION OF THE DRAWINGS

The above and other objects as well as advantageous features of the invention will become apparent from the following detailed description of the preferred embodiments taken in conjunction with the accompanying drawings.

DESCRIPTION OF THE PREFERRED EMBODIMENTS

Embodiments of the present invention will now be described with reference to the accompanying drawings.

Figures 1, 2:
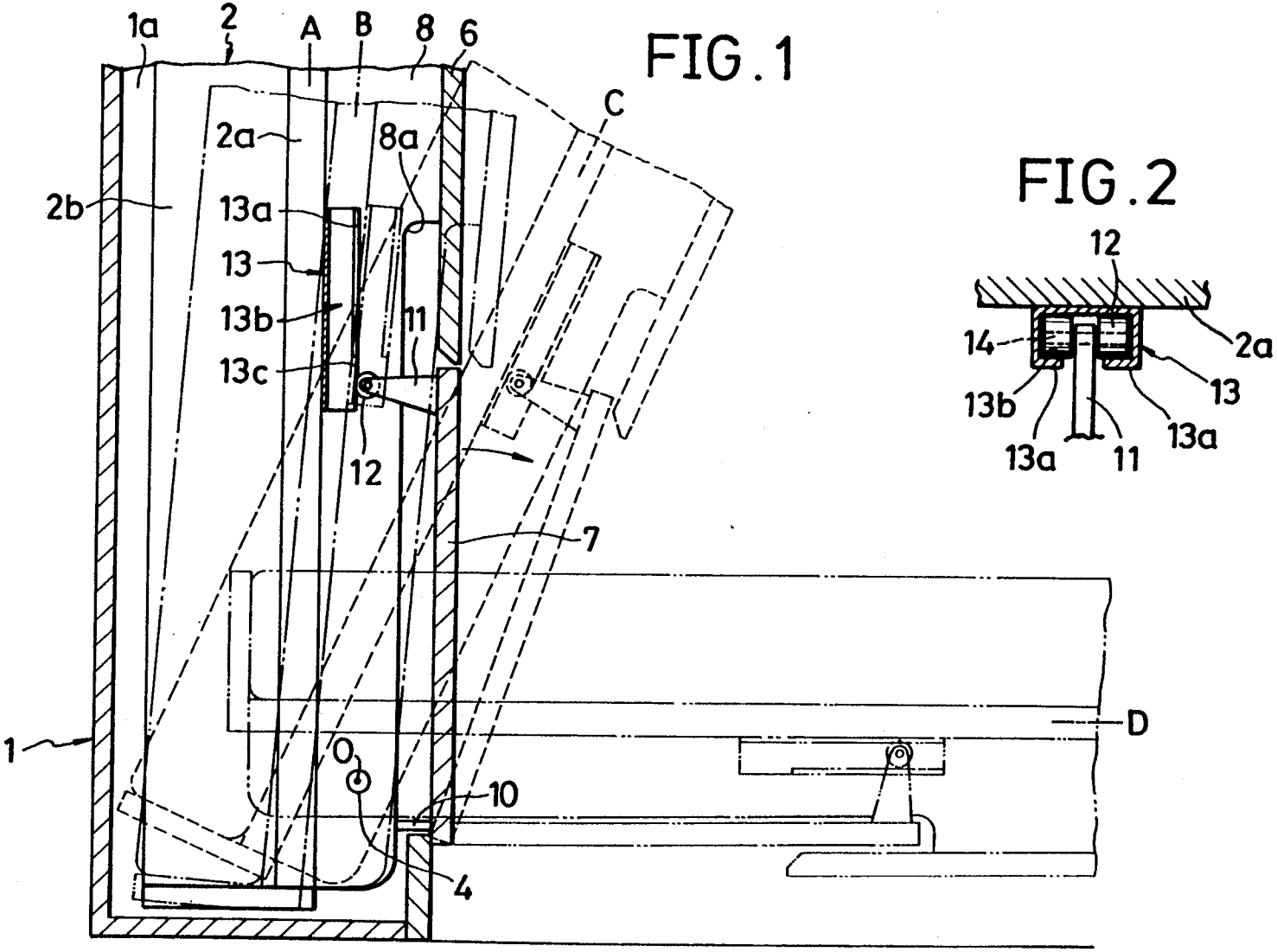
FIG. 1 is an enlarged longitudinal sectional view showing an essential portion of an embodiment according to first aspect of an apparatus for opening and closing a folding bed of the present invention.
FIG. 2 is an enlarged lateral sectional view showing an engaging state of an engaging roller with a guide rail.
Figure 3:
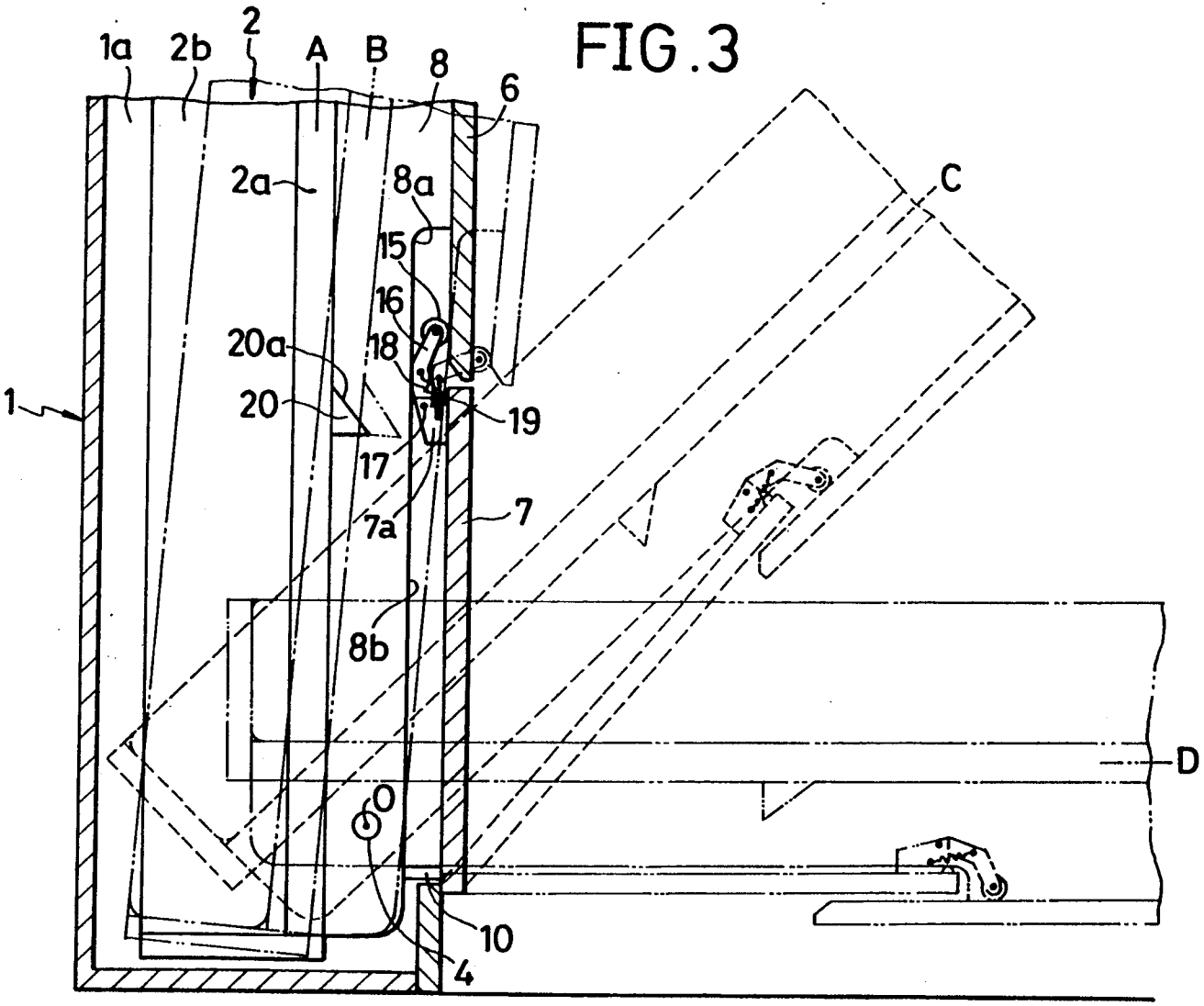
FIG. 3 is an enlarged longitudinal sectional view showing an essential portion of another embodiment according to a second aspect of the invention.
Figure 4:
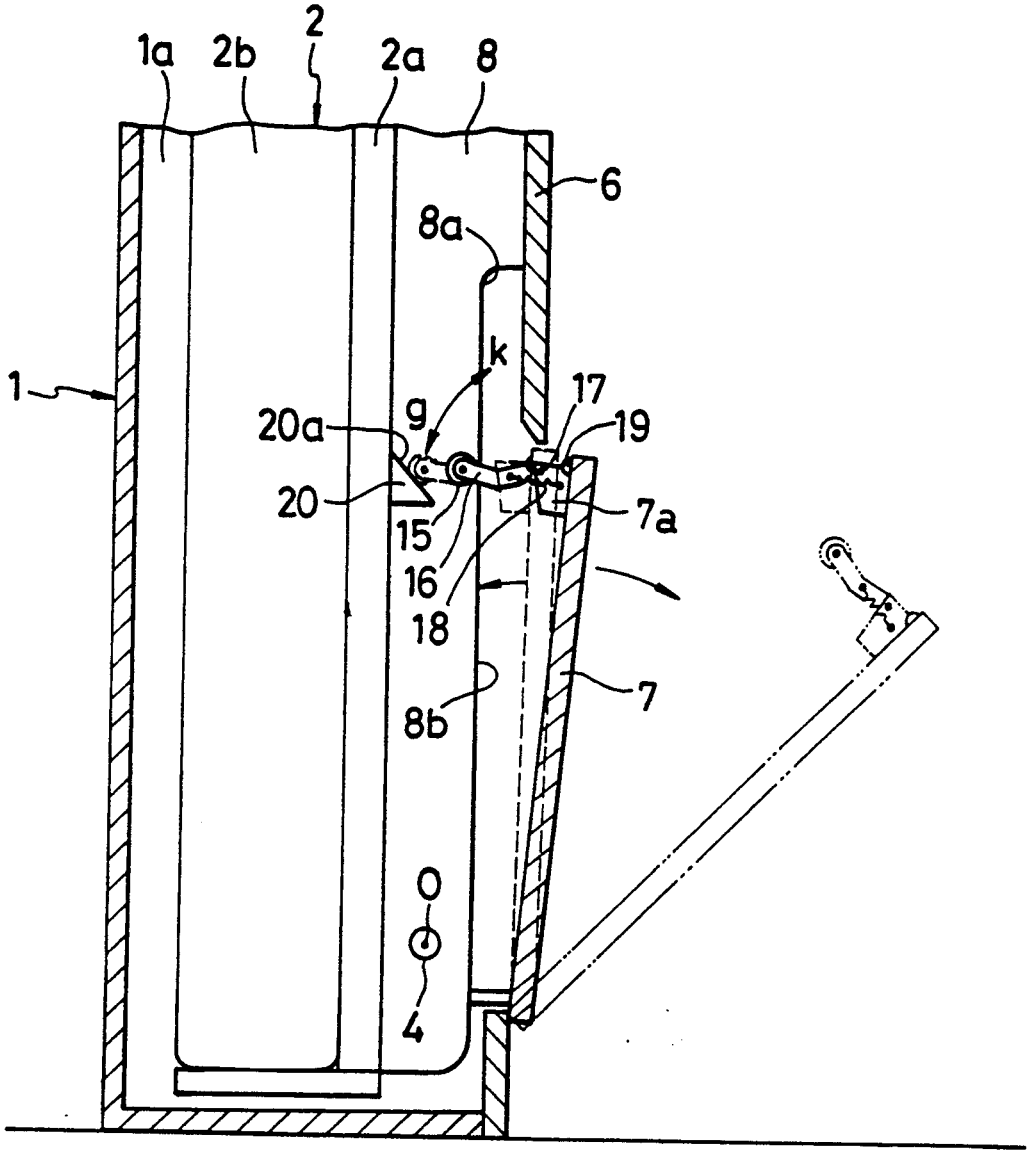
FIG. 4 is an enlarged longitudinal sectional view showing a lower panel opening and closing state.
Figure 5:
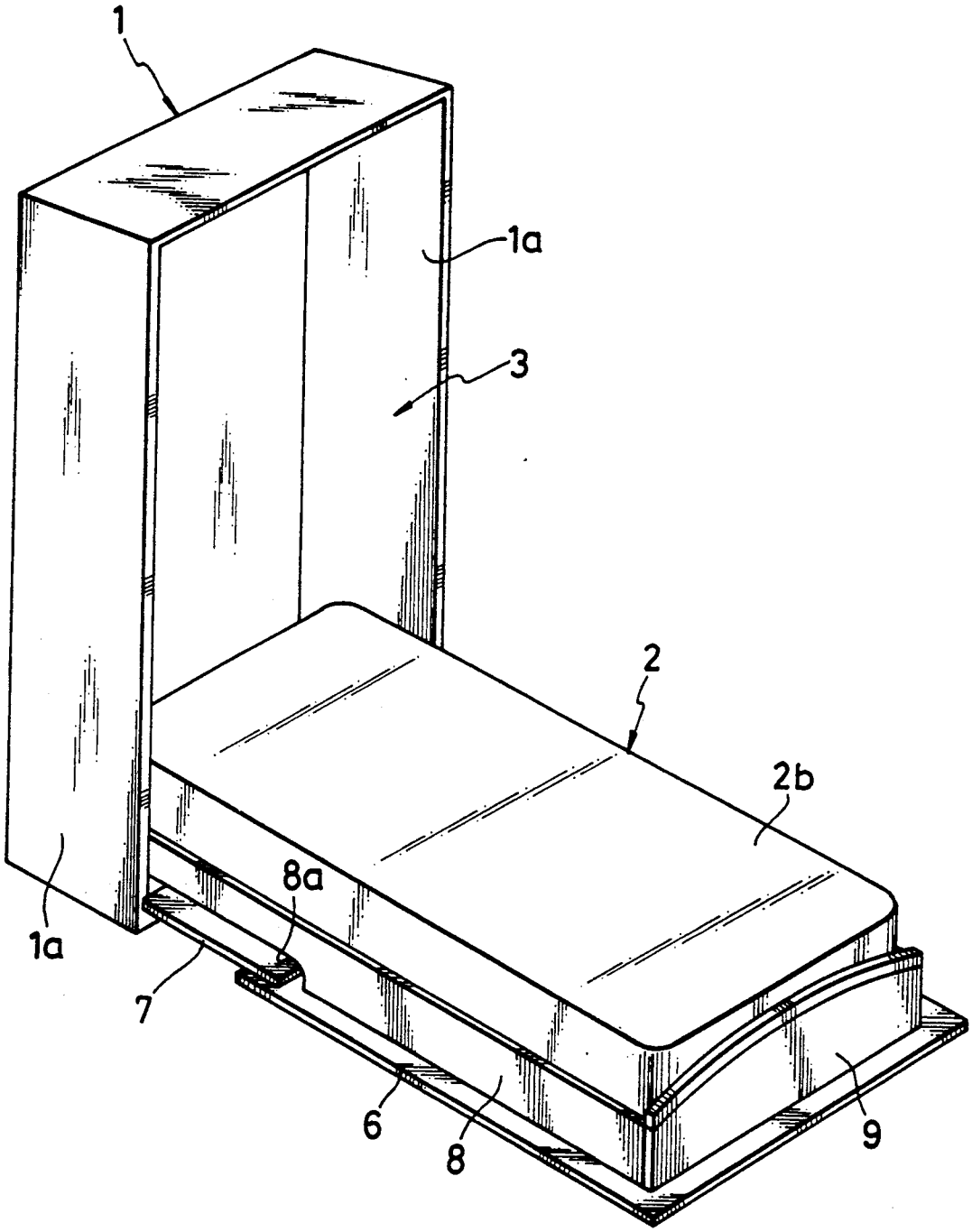
FIGS. 5, 6 and 7 are perspective views respectively showing a bed using state, a bed containing state, a partly cut-out maintenance state of the first and second aspects of the invention.
Figure 6:
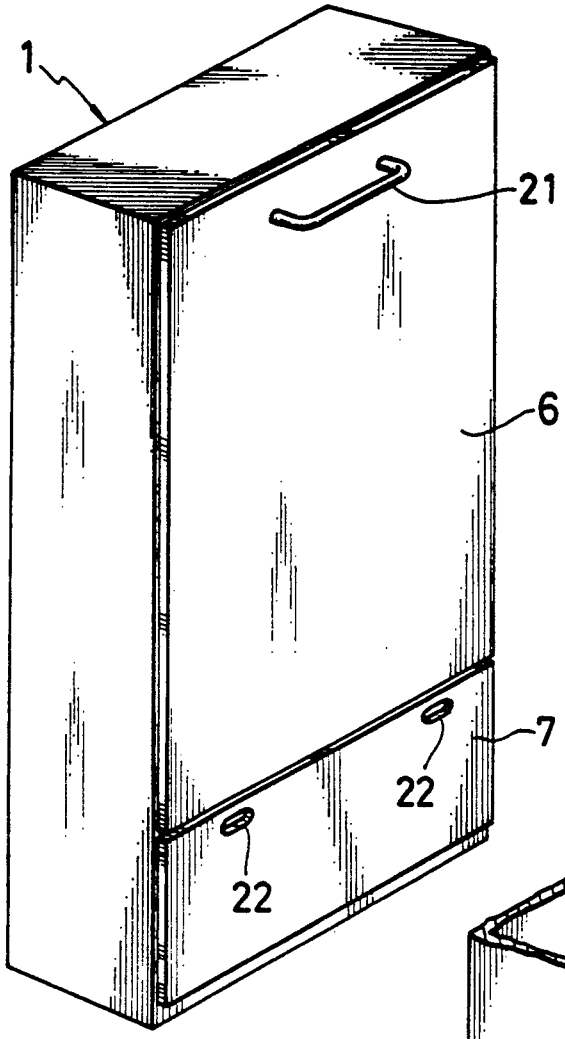
Figure 7:
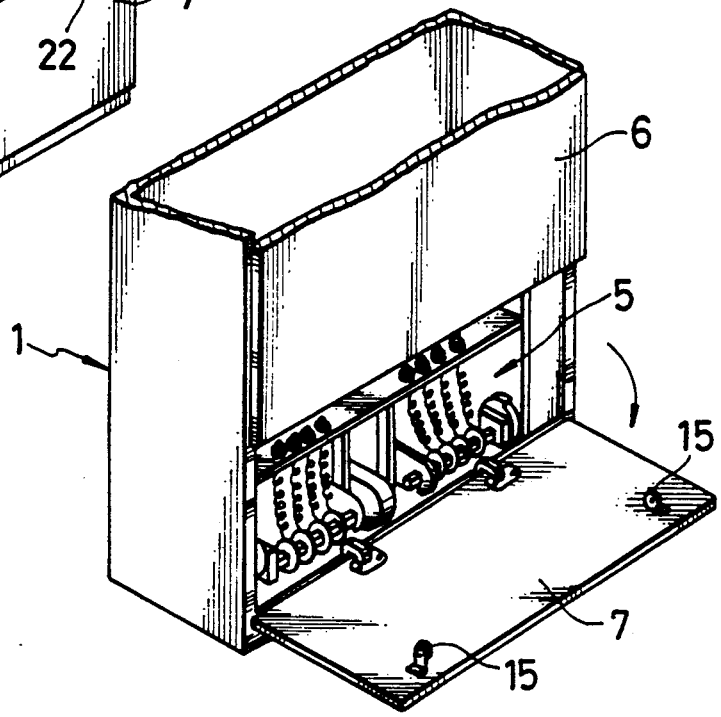
Figure 8:
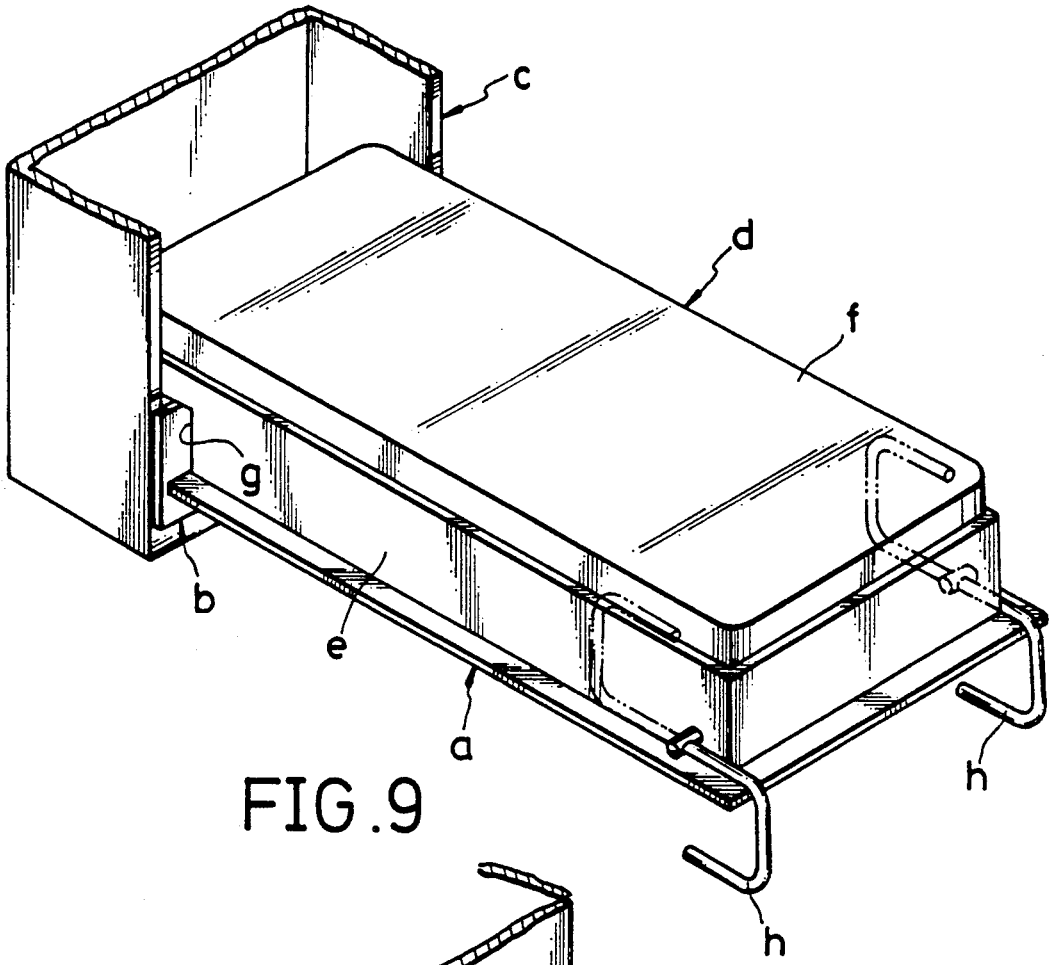
FIGS. 8 and 9 are perspective views respectively showing a bed using state and a partly cut-out maintenance state of a conventional folding bed.
Figure 9:
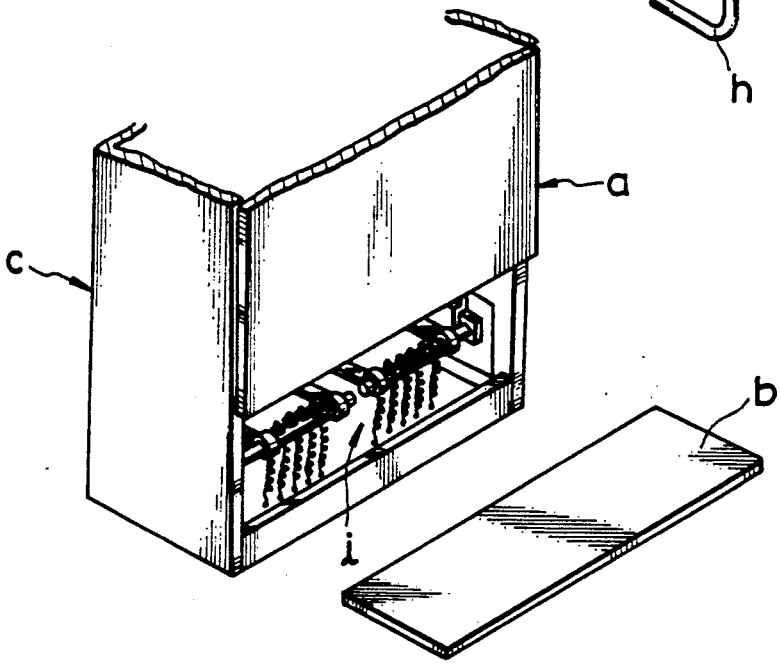

FIGS. 1 and 2 show a first embodiment according to a first aspect of the invention, FIGS. 3 and 4 show a second embodiment according to a second aspect of the invention, and FIGS. 5 to 7 respectively show a bed body using state, a bed body containing state and a maintenance working state.

According to a first aspect of the invention, as shown in FIGS. 1, 2, and 5 to 7, an opening 3 of a longitudinally long rectangular shape having a space capable of containing a bed body 2 journaled to a cabinet 1 by pivotally erecting the bed body 2 in a vertical state is divided at the front surface of a cabinet 1.

The bed body 2 is formed by lacing a mattress **2*b* on a frame 2*a* associated in a planely longitudinally rectangular shape. The base portion of the frame 2*a* is journaled to a rotational shaft 4 at the lower ends of left and right sidewalls 1*a* and 1*a* of the cabinet 1. Thus, the bed body 2 is pivotally rotated at the rotational shaft 4 as a pivotal fulcrum O with respect to the cabinet 1 to be supported by the shaft 4 to be capable of being contained in the cabinet 1**.

More particularly, the bed body 2 is a so supported as to be moved into a horizontal state to be used as a bed by pivotally rotating (opening) the bed body 2 forwardly from the opening 3 from the containing state in the cabinet 1 and back into the containing state in the opening 3 of the cabinet 1 by pivotally rotating (closing) the bed body 2 upwardly from the horizontal state. Further, as shown in FIG. 7, a rotating force in a closing direction is energized by the bed body 2 by coupling a rotating force energizing mechanism 5, known per se, composed of a plurality of springs, etc., arranged at a lower end in the cabinet 1 at the base end of the frame **2*a*, thereby holding the bed body 2** in the containing state, and smoothly performing closing work by a small force.

The front panel of the cabinet 1 is divided into an upper panel 6 and a lower panel 7.

Both the upper and lower panels 6 and 7 are so formed in lateral widths as to be of an overlapping type, wider than the lateral width of the opening 3 of the cabinet 1, and the lower panel 7 is openable for maintenance of the shaft portion of the bed body 2 and the rotating force energizing mechanism 5, etc. Therefore, the lower panel 7 is so formed of a small longitudinal size as to close the lower end of the opening 3 of the cabinet 1. On the other hand, the upper panel 6 has a longitudinal size larger than the lower panel 7 so as to close the other portions of the cabinet except the lower end of the opening 3.

The upper panel 6 is affixed to right and left side panels 8 and 8, and an upper panel 9 at the upper front side of the frame **2*a* of the bed body 2, and opened or closed integrally with the bed body 2**.

Cutout portions **8*a* necessary to include the lower panel 7 at the time of opening and closing the bed body 2 are respectively formed at the bases of the side panels 8 and 8**.

On the other hand, the lower panel 7 is pivotally secured at the lower end thereof by a hinge 10 with a catch on the lower front portion at a predetermined distance from the pivotal fulcrum O of the bed body 2 at the lower end of the opening 3 of the cabinet 1 so as to solely open or close the bed body 2 by pivotal rotation in the closing state, i.e., in the containing state in the cabinet 1.

Further, the lower panel 7 is constructed as set forth below so as to be opened or closed in cooperation with opening or closing of the bed body 2.

More specifically, at the upper end of the rear surface of the lower panel 7, an engaging roller 12 rotatable by a roller holding member 11 is secured to the frame **2*a* of the bed body 2, and a guide rail 13 is fixedly secured at the rear side thereof at a position corresponding to the engaging roller 12 an the bed body 2 in the longitudinal direction of the bed body 2**.

Here, as shown in FIG. 2, a pair of right and left engaging rollers 12 are supported pivotally rotatably to a supporting shaft 14 (or one engaging roller 12 is supported at one side to a supporting shaft 14) at the end of the roller holding member 11 fixed to the lower panel 7. On the other hand, the guide rail 13 is formed in a lateral cross sectional, substantially inverted recess shape, and formed with a stripe-shaped groove **13*b* for engaging the roller by providing roller retainers 13*a* and 13*a*** at the right and left sides of the opening thereof of longer length in a longitudinal direction thereof.

Cutout portions **13*c* are provided at the base ends of the roller retainers 13*a* and 13*a* in the stripe-shaped groove 13*b*, for engaging or disengaging the engaging roller 12 with or from the cutout portion 13*c* in the containing state for closing the bed body 2 in the cabinet 1**.

Therefore, in the containing state as shown by A in FIG. 1 for closing the bed body 2 in the cabinet 1, the engaging roller 12 is not engaged with the guide rail 13, the lower panel 7 is free with respect to the bed body 2, and in the exemplified embodiment as shown, the closing state is held by the hinge 10 with a catch. However, as the holding means of the lower panel 7, a known catch member may, of course, be employed instead of the hinge with the catch. The catch of this case may be provided with male and female members at the bed body and the lower panel, respectively.

In the apparatus for opening and closing a folding bed constituted as described above, in the containing state shown by A in FIG. 1, the engaging roller 12 is not engaged with the guide rail 13 as described above. Thus, the lower panel 7 can be opened or closed by itself. When the bed body 2 is opened to a position B in FIG. 1, the engaging roller 12 extends into the cutout **13*c* of the guide rail 13. When the bed body 2 is further opened to a position C in FIG. 1, the engaging roller 12 is engaged with the stripe-shaped groove 13*b* of the guide rail 13, and the upper end of the lower panel 7 is intruded to the upper panel 6 and the cutout portions 8*a* of the side panels 8. When the bed body 2 is further opened, the engaging roller 12 is rolled in the guide rail 13, thereby opening the lower panel 7 in cooperation with opening of the bed body 2 to introduce the bed body 2 to a bed using state shown by D in FIG. 1**.

When the bed body 2 is pivotally rotated upwardly to be closed for containment from in the cabinet 1 in the above-described bed using state, the lower panel 7 is closed in cooperation with the bed body 2 by reverse movement from the operation when the bed body 2 is opened.

In the apparatus for opening and closing a folding bed according to a second aspect of the invention, as shown in FIGS. 3 to 7, a roller arm 16 formed substantially in an L shape and rotatably journaled at one end thereof with a connecting roller 15 is pivotally secured at its base end via a pin 17 to a mounting bracket 7a fixedly secured to the inner face of the upper end of the lower panel 7. Thus, the connecting roller 15 is so provided as to be vertically rotatable to be engaged with or disengaged from the inner surface of the upper panel 6. In addition, the roller arm 16 is so energized from a neutral point both toward the inner surface of the upper panel 6 and toward an opposite direction thereto by a tension spring 18 extended at one end thereof to substantially the intermediate position of the roller arm 16 and at the other end thereof to be engaged with the mounting bracket 7a. Thus, the roller arm 16 is rotated to a position exceeding the neutral point against the tension of the spring 18. In this manner, the roller arm 16 is tilted down to the side of the upper panel 6, the connecting roller 15 is engaged therewith in the state to be pressed to the inner surface of the upper panel 6, or rotated to the opposite side thereto to be foldably erected and held as shown in FIG. 4, and disengaged from the inner surface of the upper panel 6.

Therefore, in the state shown by A in FIG. 3 in which the bed body 2 is contained in the cabinet 1, the engaging roller 15 is pressed in contact with the inner surface of the upper panel 6, thereby holding the lower panel 7 in the closing state and cooperating the lower panel 7 with closing of the bed body 2.

When the bed body 2 is opened to be tilted down, the inner face of the upper end of the lower panel 7 is brought into contact with the end face 8b of the cutout portion 8a of the side panel 8 to move the lower panel 7. Further, a slide rivet 19 is clamped to the inner face of the upper end of the lower panel 7 so as to smoothly slide the lower panel 7 to the end face 8b of the cutout portion 8a of the side panel 7 when the bed body 2 is sequentially opened to the positions A, B, C and D in FIG. 3.

Therefore, when the lower panel 7 is opened forwardly from the containing state of the bed body 2, the roller arm 16 is rotated to a position exceeding a neutral point against the tension of the spring 18 by means of the opening force of the lower panel 7. Then, the roller arm 16 is rotated in a direction of an arrow g in FIG. 4 by the tension of the spring as shown in FIG. 4 to be held in an erecting state. Thus, the lower arm 16 is disengaged from the upper panel 6, and the lower panel 7 can be opened by itself.

When the lower panel 7 is closed to the vicinity of its full closure, the connecting roller 15 is brought into contact with the rear surface of the bed body 2. Thus, the roller arm 16 is rotated to a position exceeding a neutral point in a direction of an arrow k in FIG. 4 against the tension of the spring. Then, the roller arm 16 is tilted upward by the tension of the spring to be pressed in engagement with the inner surface of the upper panel 6, and the lower panel 7 is held at a closing position.

It is noted that the connecting roller 15 may be pressed in contact directly with the rear surface of the bed body 2 to be tilted down. In the exemplified embodiment as shown, a pressing member 20 is fixedly secured to the rear surface of the bed body 2, and an oblique surface 20a of the contact surface of the connecting roller 15 is formed on the pressing member 20, thereby smoothly and surely pressing the roller arm 16.

In FIG. 6, a handle 21 used also as a leg is provided on the upper panel 6, and one or more other handles 22 are provided on the lower panel 7.

In the apparatus for opening and closing the folding bed according to the second aspect of the invention, the other parts other than those described above act the same as that of the apparatus according to the first aspect of the invention.

Since the present invention is constituted as described above, according to the first aspect of the embodiment of the invention, the lower panel can be solely opened or closed in the containing state of the bed body in the cabinet. Therefore, maintenance for the area adjacent to the shaft disposed in the lower portion in the cabinet and the rotating force energizing mechanism of the bed body, etc., is facilitated. Further, since the lower panel is cooperated with opening and closing of the bed body, the frame of the bed body, the side panels, etc., may not necessarily be formed in a relief shape for the lower panel. Moreover, since the mattress surface can be lowered in the bed using state and the gap between the bed body and a floor surface can be reduced, the handles of the bed body can be used also as legs at the time of using of the bed. Therefore, the extension or retraction of the legs at the time of opening or closing the bed body is not required, thereby maintaining a design feeling equivalent to a normal bed without containing type and simplifying opening and closing of the bed body to provide excellent operability.

According to the second aspect of the preferred embodiment of the invention, the connecting roller to be rotatably energized by the spring to be divided from the neutral point toward both directions is further engaged with the panel, thereby holding the lower panel. Therefore, closing and holding of the lower panel at the time of containing the bed body in the cabinet can be reliably performed. Further, even if the lower panel is erroneously pressed by a foot in the bed using state, the engaging roller and the lower panel are rotated against the tension of the spring and relieved downward. Accordingly, the lower panel is not damaged.

What is claimed is:

1. An apparatus for opening and closing a folding bed, said apparatus comprising:

a bed body pivotally secured to a cabinet, a front panel divided into an upper panel fixed to said bed body and a lower panel, said lower panel being pivotally secured at a lower end thereof to a lower front portion of said bed body spaced from a pivotal fulcrum of said bed body so as to be opened or closed by the pivotal rotation of said bed body, a guide rail provided on said bed body, and an engaging roller projected from said lower panel and coupled to said guide rail to be movable along said guide rail upon opening and closing of said bed body, said lower panel being opened or closed in cooperation with said bed body at a time of opening or closing said bed body.

2. An apparatus for opening and closing a folding bed, said apparatus comprising:

a bed body pivotally secured to a cabinet, a front panel divided into an upper panel fixed to said bed body and a lower panel, said lower panel being pivotally secured at a lower end thereof to a lower front portion of said bed body spaced from a pivotal fulcrum of said bed body so as to be opened or closed by the pivotal rotation of said bed body, a connecting roller at an upper portion of an inner surface of said lower panel and provided so that when both said upper and lower panels are pivoted in an upward or a downward direction said connecting roller is engaged with or disengaged from said upper panel, said connecting roller being connected to the inner surface of said upper panel to be coupled movably with respect to an opening or closing direction of said bed body, said lower panel being opened or closed in cooperation with said bed body at a time of opening or closing said bed body, said connecting roller being moved upward or tilted down by an opening force applied to said lower panel and said bed body at the time of opening or closing said bed body.

* * * * *